US011495905B2

(12) United States Patent
Chang et al.

(10) Patent No.: US 11,495,905 B2
(45) Date of Patent: Nov. 8, 2022

(54) ELECTRICAL PLUG CONNECTOR

(71) Applicant: ADVANCED-CONNECTEK INC., New Taipei (TW)

(72) Inventors: Ming-Yung Chang, New Taipei (TW); Tzu-Hao Li, New Taipei (TW); Chia-Cheng He, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 18 days.

(21) Appl. No.: 17/025,584

(22) Filed: Sep. 18, 2020

(65) Prior Publication Data

US 2021/0091521 A1 Mar. 25, 2021

Related U.S. Application Data

(60) Provisional application No. 62/902,687, filed on Sep. 19, 2019.

(51) Int. Cl.

| | |
|---|---|
| ***H01R 13/424*** | (2006.01) |
| ***H01R 24/60*** | (2011.01) |
| ***H01R 13/506*** | (2006.01) |
| ***H01R 13/405*** | (2006.01) |
| ***H01R 13/26*** | (2006.01) |
| ***H01R 13/42*** | (2006.01) |
| ***H01R 13/627*** | (2006.01) |
| ***H01R 13/629*** | (2006.01) |
| ***H01R 13/6583*** | (2011.01) |
| ***H01R 13/11*** | (2006.01) |
| ***H01R 107/00*** | (2006.01) |

(52) U.S. Cl.

CPC ..... *H01R 13/424* (2013.01); *H01R 13/11* (2013.01); *H01R 13/26* (2013.01); *H01R 13/405* (2013.01); *H01R 13/42* (2013.01); *H01R 13/506* (2013.01); *H01R 13/629* (2013.01); *H01R 13/6271* (2013.01); *H01R 13/6583* (2013.01); *H01R 24/60* (2013.01); *H01R 2107/00* (2013.01)

(58) Field of Classification Search

None

See application file for complete search history.

(56) References Cited

U.S. PATENT DOCUMENTS 10,050,369 B1 * 8/2018 Yang ..... H01R 13/405
2016/0149345 A1 * 5/2016 Liu ..... H01R 24/60 439/607.01

(Continued)

*Primary Examiner* — Oscar C Jimenez

(74) *Attorney, Agent, or Firm* — Muncy, Geissler, Olds & Lowe, P.C.

(57) ABSTRACT

An electrical plug connector includes a metallic shell, a first insulated housing, a second insulated housing, a first terminal module, and a second terminal module. The first terminal module includes the first terminals and the first assembling block combined with each other to form a one-piece member, and then the first insulated housing is further combined with the first terminal module. The second terminal module includes the second terminals and the second assembling block combined with each other to form a one-piece member, and then the second insulated housing is further combined with the second terminal module. The four-piece component is assembled into the metallic shell. Accordingly, the number of the components for manufacturing the connector can be reduced, thereby simplifying the assembling procedure for the connector.

20 Claims, 17 Drawing Sheets

(56) References Cited

U.S. PATENT DOCUMENTS

| | | | | |
|---|---|---|---|---|
| 2017/0229810 | A1* | 8/2017 | Zhang | H01R 13/502 |
| 2019/0027868 | A1* | 1/2019 | Tsai | H01R 13/112 |
| 2019/0036264 | A1* | 1/2019 | Chien | H01R 12/724 |
| 2021/0005999 | A1* | 1/2021 | Chen | H01R 13/424 |

* cited by examiner

ELECTRICAL PLUG CONNECTOR

CROSS-REFERENCE TO RELATED APPLICATION

This non-provisional application claims priority under 35 U.S.C. § 119(e) to U.S. Provisional Patent Application No. 62/902,687, filed on Sep. 19, 2019, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a USB type-C electrical connector known to the inventor(s) are totally different from those of a USB electrical connector known to the inventor(s). A USB type-C electrical receptacle connector known to the inventor(s) includes a one-piece primary plastic core, upper-row plug terminals and lower-row plug terminals held on the primary plastic core, secondary plastic cores respectively assembled with the upper-row plug terminals and the lower-row plug terminals, a hook member between the upper-row plug terminals and the lower-row plug terminals, an outer iron shell circularly enclosing the primary plastic core and the secondary plastic cores, and conductive pieces on the primary plastic core and the secondary plastic cores.

SUMMARY OF THE INVENTION

In general, the assembling procedure for a USB type-C electrical plug connector known to the inventor(s) is, the upper-row plug terminals, the lower-row plug terminals, and the hook member are stacked with each other, and then the assembly is positioned using the positioning holes and posts on the upper secondary plastic core and the lower secondary plastic core, respectively. The upper-row plug terminals, the lower-row plug terminals and the hook member are assembled as one assembly, and then the assembly is further assembled with the primary plastic core to form a two-part component. Moreover, the upper-row plug terminals and the lower-row plug terminals are assembled with the primary plastic core from the rear portion of the primary plastic core, so that the upper-row plug terminals and the lower-row plug terminals are inserted into the primary plastic core. For the USB type-C electrical plug connector known to the inventor(s), the assembling components have many types, and the assembling components are assembled with each other to form the connector through complicated assembling steps. As a result, the assembly for the connector is time-consuming and defect products would be produced easily.

In view of these, according to one or some embodiments of the instant disclosure, an electrical plug connector is provided. The electrical plug connector comprises a metallic shell, a first insulated housing, a second insulated housing, a first terminal module, and a second terminal module. The metallic shell comprises a receiving cavity. The first insulated housing comprises a first inner assembling space. The first terminal module comprises a plurality of first terminals and a first assembling block. The first assembling block is combined with the first terminals and is in the first inner assembling space of the first insulated housing. The second insulated housing comprises a second inner assembling space. The second terminal module comprises a plurality of second terminals and a second assembling block. The second assembling block is combined with the second terminals and is in the second inner assembling space. The first insulated housing assembled with the first terminal module and the second insulated housing assembled with the second terminal module are combined with each other and together received in the receiving cavity of the metallic shell. An insertion cavity is between an inner side of an assembly of the first insulated housing and the second insulated housing after the first insulated housing is combined with the second insulated housing.

Another embodiment of the instant disclosure provides an electrical plug connector. The electrical plug connector comprises a metallic shell, a first insulated housing, a first terminal module, a second insulated housing, and a second terminal module. The metallic shell comprises a receiving cavity along a longitudinal direction. The first insulated housing comprises a first inner assembling space. The first terminal module comprises a plurality of first terminals and a first assembling block. The first assembling block is received in the first inner assembling space of the first insulated housing along a vertical direction. The second insulated housing comprises a second inner assembling space. The second terminal module comprises a plurality of second terminals and a second assembling block. The second assembling block is received in the second inner assembling space of the second insulated housing along the vertical direction. The first insulated housing assembled with the first terminal module and the second insulated housing assembled with the second terminal module are combined with each other along the vertical direction and together received in the receiving cavity of the metallic shell. An insertion cavity is between an inner side of an assembly of the first insulated housing and the second insulated housing after the first insulated housing is combined with the second insulated housing along the vertical direction.

Further another embodiment of the instant disclosure provides an electrical plug connector. The electrical plug connector comprises a metallic shell, a first insulated housing, a first terminal module, a second insulated housing, a second terminal module, and two side latches. The metallic shell comprises a receiving cavity. The first insulated housing comprises a first inner assembling space. The first terminal module comprises a plurality of first terminals and a first assembling block. The first assembling block is received in the first inner assembling space of the first insulated housing. The second insulated housing comprises a second inner assembling space. The second terminal module comprises a plurality of second terminals and a second assembling block. The second assembling block is received in the second inner assembling space of the second insulated housing. The two side latches are disposed on two sides of the first insulated housing and the second insulated housing along a transverse direction. Each of the side latches comprises a side arm and a latch portion. The latch portion is at a front portion of the side arm and inserted into the insertion cavity along the transverse direction. The first insulated housing assembled with the first terminal module and the second insulated housing assembled with the second terminal module are combined with each other along a vertical direction and together received in the receiving cavity of the metallic shell. An insertion cavity is between an inner side of an assembly of the first insulated housing and the second insulated housing after the first insulated housing is combined with the second insulated housing.

In one or some embodiments, the first assembling block is received and retained in the first inner assembling space of the first insulated housing and the second assembling block is received and retained in the second inner assembling space of the second insulated housing.

In one or some embodiments, each of the first terminals is a bent-type terminal and comprises a first flexible contact portion, a first body portion, and a first tail portion. The first body portions are held in the first assembling block. For each of the first terminals, the first flexible contact portion extends forward from the first body portion in a rear-to-front direction, and the first tail portion extends backward from the first body portion in a front-to-rear direction and protrudes out of the first assembling block.

In one or some embodiments, each of the second terminals is a bent-type terminal and comprises a second flexible contact portion, a second body portion, and a second tail portion. The second body portions are held in the second assembling block. For each of the second terminals, the second flexible contact portion extends forward from the second body portion in a rear-to-front direction, and the second tail portion extends backward from the second body portion in a front-to-rear direction and protrudes out of the second assembling block.

In one or some embodiments, two sides of the first insulated housing comprise two first buckling grooves, two sides of the first assembling block comprise two first engaging blocks, and each of the first engaging blocks is engaged with the corresponding first buckling groove.

In one or some embodiments, two sides of the second insulated housing comprise two second buckling grooves, two sides of the second assembling block comprise two second engaging blocks, and each of the second engaging blocks is engaged with the corresponding second buckling groove.

In one or some embodiments, an inner side of the first assembling block comprises a first positioning structure, an inner side of the second assembling block comprises a second positioning structure, and the first positioning structure is combined with the second positioning structure.

In one or some embodiments, the electrical plug connector further comprises a metallic member between the first insulated housing and the second insulated housing. The metallic member comprises a buckling hole and two side latches, the buckling hole is provided for being inserted by the first positioning structure, and the two side latches respectively extend from two sides of the metallic member along a rear-to-front direction.

In one or some embodiments, each of the side latches comprises a side arm and a latch portion. The latch portion is at a front portion of the side arm and inserted into the insertion cavity along a transverse direction.

In one or some embodiments, the electrical plug connector further comprises two side latches disposed on two sides of the first insulated housing and the second insulated housing along a transverse direction. Each of the side latches comprises a side arm and a latch portion. The latch is at a front portion of the side arm and inserted into the insertion cavity along the transverse direction.

In one or some embodiments, the electrical plug connector further comprises a first metallic sheet and a second metallic sheet. The first metallic sheet is on the first insulated housing, and the second metallic sheet is on the second insulated housing.

According to one or some embodiments of the instant disclosure, the first terminal module comprises the first terminals and the first assembling block combined with each other to form a one-piece member by injection molding, and then the first insulated housing is further combined with the first terminal module; likewise, the second terminal module comprises the second terminals and the second assembling block combined with each other to form a one-piece member by injection molding, and then the second insulated housing is further combined with the second terminal module. The four-piece component is assembled into the metallic shell. Accordingly, the number of the components for manufacturing the connector can be reduced, thereby simplifying the assembling procedure for the connector. Moreover, after the first assembling block and the second assembling block are respectively combined with the first terminals and the second terminals, the first terminal module and the second terminal module provide waterproof function.

According to one or some embodiments of the instant disclosure, the first bent-type terminals and the second bent-type terminals meet the Gen2 specification, and the first bent-type terminals and the second bent-type terminals are served as terminals for signal transmission. Conversely, the first blanking-type terminals and the second blanking-type terminals are served as terminals for power transmission. The cross-sectional area of the blanking-type terminal is greater than the cross-sectional area of the bent-type terminal thereby suitable for transmitting a current having 6 Amps or more.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
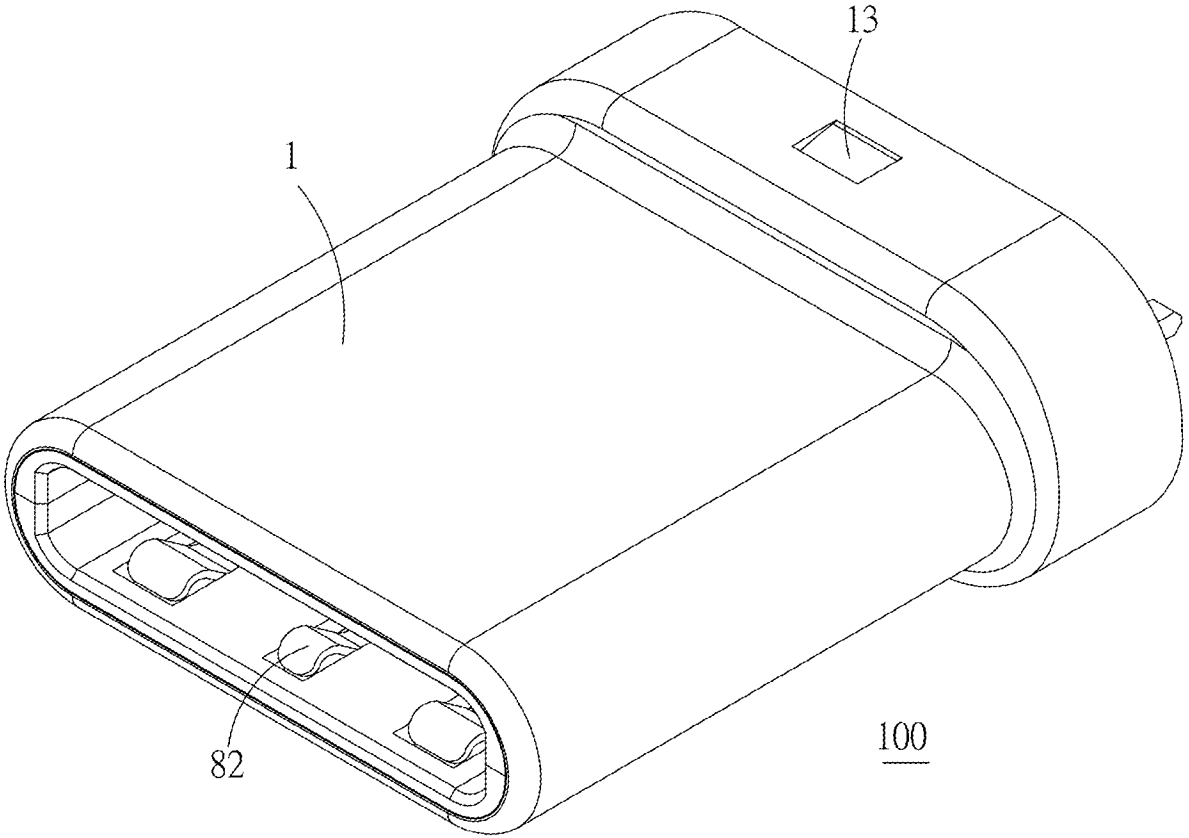
FIG. 1 illustrates a perspective view of an electrical plug connector according to a first embodiment of the instant disclosure.
Figure 2:
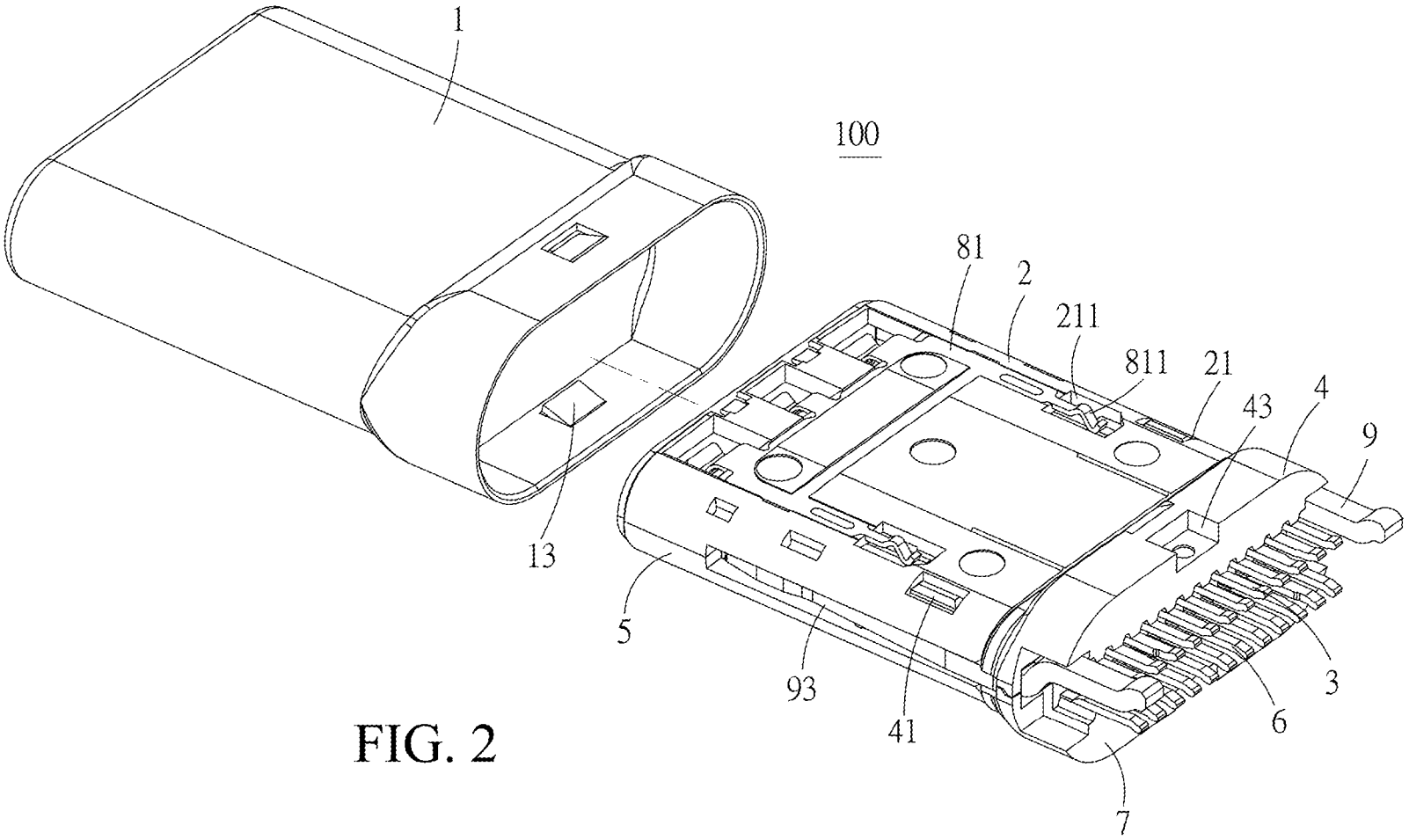
FIG. 2 illustrates an exploded view (1) of the electrical plug connector of the first embodiment.
Figure 3:
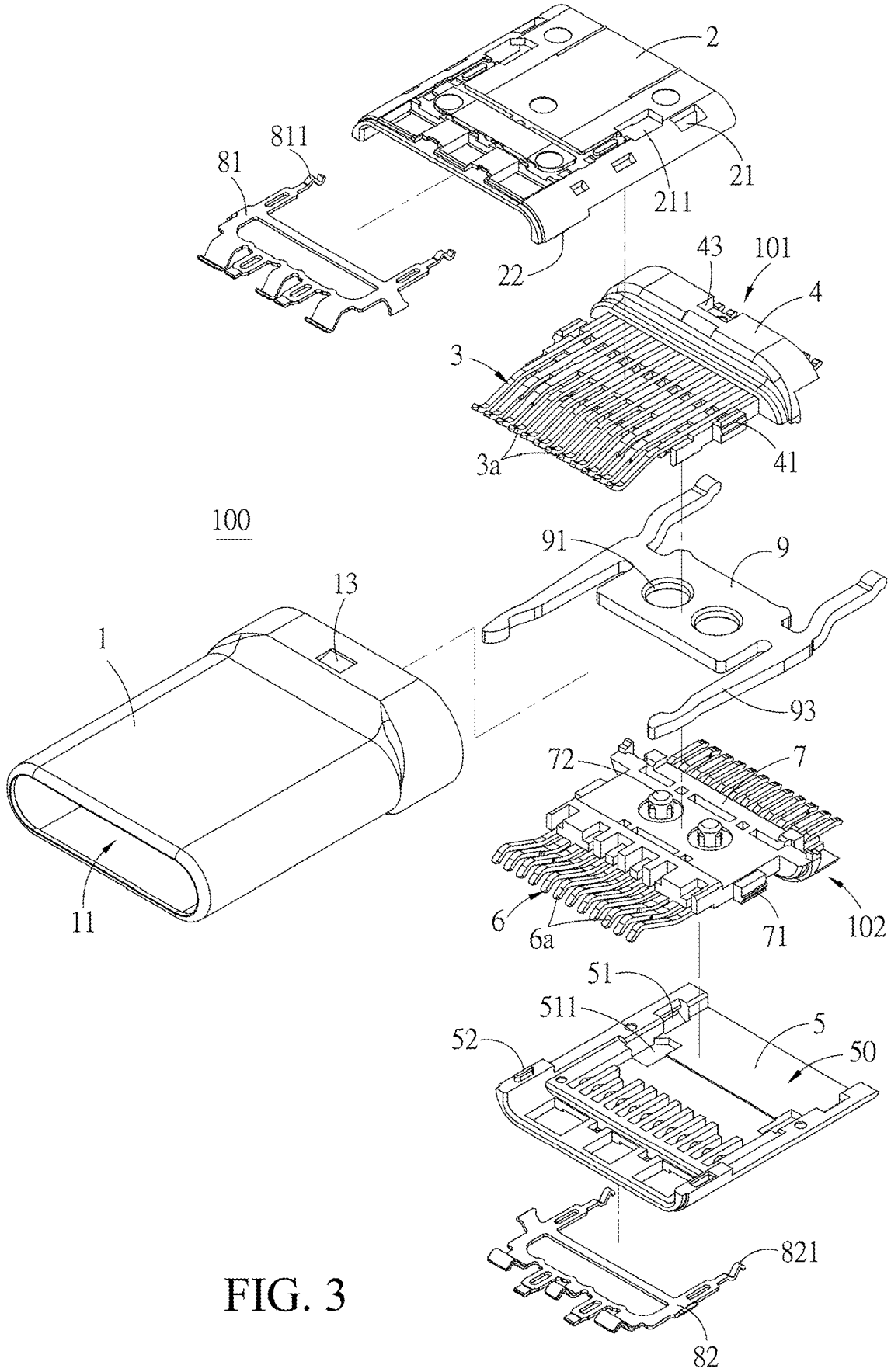
FIG. 3 illustrates an exploded view (2) of the electrical plug connector of the first embodiment.
Figure 4:
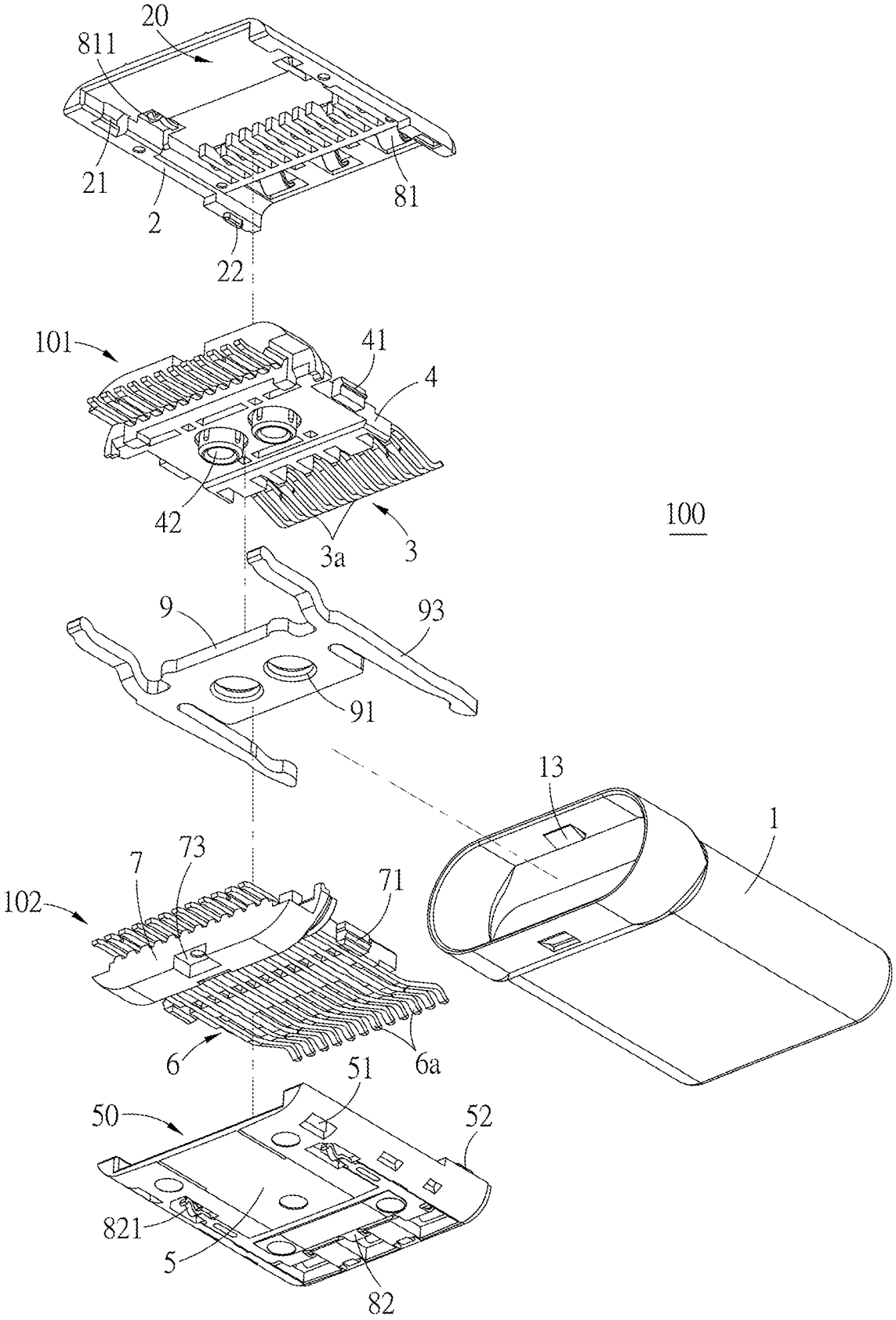
FIG. 4 illustrates an exploded view (3) of the electrical plug connector of the first embodiment.

Please refer to FIGS. 1 to 4. An electrical plug connector 100 according to a first embodiment of the instant disclosure is illustrated. FIG. 1 illustrates a perspective view of the electrical plug connector 100 of the first embodiment. FIG. 2 illustrates an exploded view (1) of the electrical plug connector of the first embodiment. FIG. 3 illustrates an exploded view (2) of the electrical plug connector 100 of the first embodiment. FIG. 4 illustrates an exploded view (3) of the electrical plug connector 100 of the first embodiment. Specifically, FIG. 3 illustrates a front exploded view of the electrical plug connector 100 of the first embodiment, and FIG. 4 illustrates a rear exploded view of the electrical plug connector 100 of the first embodiment. In this embodiment, the electrical plug connector 100 can provide a reversible or dual orientation USB Type-C connector interface and pin assignments, i.e., a USB Type-C plug connector, but embodiments are not limited thereto. The electrical plug connector 100 comprises a metallic shell 1, a first insulated housing 2, a first terminal module 101, a second insulated housing 5, and a second terminal module 102.

Please refer to FIGS. 1 to 4. In some embodiments, the metallic shell 1 comprises a receiving cavity 11, and the metallic shell 1 encloses the first insulated housing 2 and the second insulated housing 5. In other words, the first insulated housing 2 and the second insulated housing 5 are assembled with each other and received in the receiving cavity 11 along a longitudinal direction (i.e. a rear-to-front direction or a front-to-rear direction). The metallic shell 1 is a hollowed shell formed by deep drawing techniques. In other words, the metallic shell 1 is a unitary element and is a seamless shell. The metallic shell 1 has a beautiful appearance and improved structural strength. In this embodiment, the metallic shell 1 is a unitary member, but embodiments are not limited thereto. In some embodiments, several pieces may be bent to form the metallic shell 1. Moreover, the upper inner side and the lower inner side of the rear portion of the metallic shell 1 are bent to form buckling pieces 13. The buckling pieces 13 are respectively buckled with a recessed portion 43 of a first assembling block 4 of the first terminal module 101 and a recessed portion 73 of a second assembling block 7 of the second terminal module 102.

Please refer to FIGS. 1 to 4. In some embodiments, the first insulated housing 2 comprises a first inner assembling space 20 along a vertical direction, and the second insulated housing 5 comprises a second inner assembling space 50 along the vertical direction.

Please refer to FIGS. 1 to 4. In some embodiments, the first terminal module 101 comprises a plurality of first terminals 3 and the first assembling block 4. The first assembling block 4 is molded with the first terminals 3 to form a first terminal module 101 and then the first assembling block 4 is received and retained in the first inner assembling space 20 of the first insulated housing 2 along the vertical direction (e.g., the inner surface of the first insulated housing 2). Alternatively, the first terminals 3 are assembled to the first assembling block 4 to form the first terminal module 101 and then the first assembling block 4 is received and retained in the first inner assembling space 20 of the first insulated housing 2 along the vertical direction.

Furthermore, the first assembling block 4 includes a front portion and a rear portion. Each of the first terminals 3 includes a first flexible contact portion 35, a first body portion 36, and a first tail portion 37. The first flexible contact portions 35 of the first terminals 3 protrude out the front portion of the first assembling block 4 along a rear-to-front direction. The first body portions 36 of the first terminals 3 are retained in the first assembling block 4. The first tail portions 37 of the first terminals 3 protrude out the rear portion of the first assembling block 4 along a front-to-rear direction. In this embodiment, when the first terminal module 101 is assembled with the first insulated housing 2 along the vertical direction, the front portion of the first assembling block 4 is received and retained in the first inner assembling space 20 of the first insulated housing 2 along the vertical direction and the rear portion of the first assembling block 4 is behind the first insulated housing 2. However, embodiments are not limited thereto.

Please refer to FIGS. 1 to 4. In some embodiments, the second terminal module 102 comprises a plurality of second terminals 6 and a second assembling block 7. The second assembling block 7 is molded with the second terminals 6 to form a second terminal module 102 and then the second assembling block 7 is received and retained in the second inner assembling space 50 of the second insulated housing 5 along the vertical direction (e.g., the inner surface of the second insulated housing 5). Alternatively, the second terminals 6 are assembled to the second assembling block 7 to form a second terminal module 102 and then the second assembling block 7 is received and retained in the second inner assembling space 50 of the second insulated housing 5 along the vertical direction.

Furthermore, the second assembling block 7 includes a front portion and a rear portion. Each of the second terminals 6 includes a second flexible contact portion 65, a second body portion 66, and a second tail portion 67. The second flexible contact portions 65 of the second terminals 6 protrude out the front portion of the second assembling block 7 along a rear-to-front direction. The second body portions 66 of the second terminals 6 are retained in the second assembling block 7. The second tail portions 67 of the second terminals 6 protrude out the rear portion of the second assembling block 7 along a front-to-rear direction. In this embodiment, when the second terminal module 102 is assembled with the second insulated housing 5 along the vertical direction, the front portion of the second assembling block 7 is received and retained in the second inner assembling space 50 of the second insulated housing 5 along the vertical direction and the rear portion of the second assembling block 7 is behind the second insulated housing 5 along the front-to-rear direction. However, embodiments are not limited thereto.

Please refer to FIGS. 1 to 4. In some embodiments, the first terminal module 101, the second terminal module 102, the first insulated housing 2, and the second insulated housing 5 are assembled with each other along the vertical direction to form a four-piece assembly, and an insertion cavity is formed along the longitudinal direction and is between an inner side of the assembly of the first insulated housing 2 and the second insulated housing 5.

The first insulated housing 2, the second insulated housing 5, the first terminal module 101, and the second terminal module 102 are received in the receiving cavity 11 of the metallic shell 1. The longitudinal direction is perpendicular to the vertical direction.

The first insulated housing 2 assembled with the first terminal module 101 along the vertical direction and the second insulated housing 5 assembled with the second terminal module 102 along the vertical direction are combined with each other and together received in the receiving cavity 11 of the metallic shell 1.

In some embodiments, the first terminal module 101 comprises the first terminals 3 and the first assembling block 4 combined with each other to form a one-piece member by injection molding (or by insert-molding), thereby forming the first part, and then the first part is further combined with the first insulated housing 2 (the second part). Likewise, the second terminal module 102 comprises the second terminals 6 and the second assembling block 7 combined with each other to form a one-piece member by injection molding (or by insert-molding), thereby forming the third part, and then the third part is further combined with the second insulated housing 5 (the fourth part).

Figure 8:
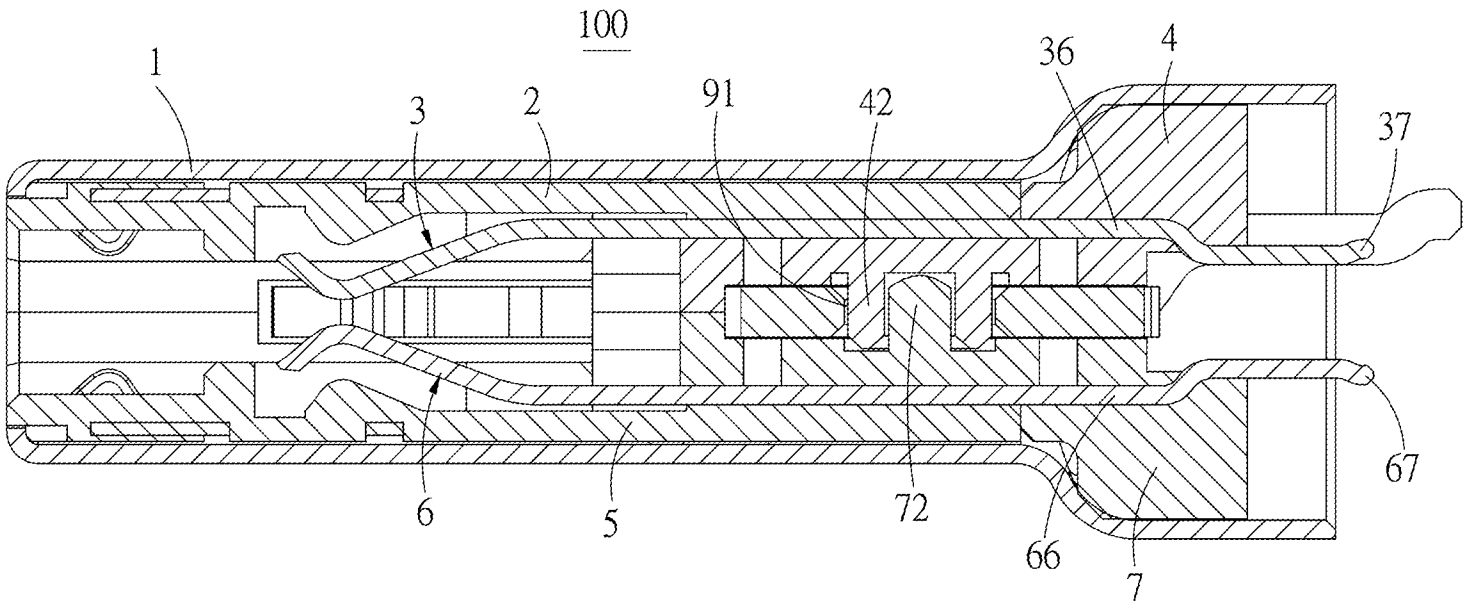
FIG. 8 illustrates a side sectional view of the electrical plug connector of the first embodiment.

In some embodiments, the first terminals 3 and the first assembling block 4 are closely combined with each other, thereby preventing moist from entering into the electrical plug connector 100 from the insertion side at the front portion of the electrical plug connector 100 (as the opening of the insertion cavity of the connector shown in FIG. 8), flowing through the contact portions between the first terminals 3 and the first assembling block 4 (as the terminal groove of the first assembling block 4 shown in FIG. 8), and flowing into the soldering side at the rear portion of the electrical plug connector 100 (as the first tail portions 37 and the second tail portions 67 of the connector shown in FIG. 8).

In some embodiments, the second terminals 6 and the second assembling block 7 are closely combined with each other, thereby preventing moist from entering into the electrical plug connector 100 from the insertion side at the front portion of the electrical plug connector 100 (as the opening of the insertion cavity of the connector shown in FIG. 8), flowing through the contact portions between the second terminals 6 and the second assembling block 7 (as the terminal groove of the second assembling block 7 shown in FIG. 8), and flowing into the soldering side at the rear portion of the electrical plug connector 100 (as the first tail portions 37 and the second tail portions 67 of the connector shown in FIG. 8).

In some embodiments, it is realized that, in a process known to the inventor(s), the blanking-type terminals and the corresponding assembling block are combined with each other by assembling. The assembling block has several terminal grooves, and the blanking-type terminals are respectively inserted into the terminal grooves. A gap is formed between each of the blanking-type terminals and the corresponding terminal groove (since the opening of each of the terminal grooves has to allow the insertion of the corresponding blanking-type terminal, a gap is formed between each of the blanking-type terminals and the corresponding terminal groove after the terminal is inserted into the terminal groove). As a result, moist may enter into the connector easily thereby reducing the waterproof performance of the connector.

In some embodiments, the four parts, that is, first terminal module 101, the second terminal module 102, the first insulated housing 2, and the second insulated housing 5 are assembled with each other, and then the assembly is assembled into the metallic shell 1.

Accordingly, the assembling components are simplified as the upper component (the assembly of the first part and the second part) and the lower component (the assembly of the third part and the fourth part), and then the upper component and the lower component are assembled into the receiving cavity 11 of the metallic shell 1. Hence, the number of the components for manufacturing the connector can be reduced, thereby simplifying the assembling procedure for the connector. Moreover, it is understood that, in some embodiments, stopping sheets (the stopping sheet may be, but not limited to polyester sheet (Mylar)) respectively provided between the first terminal module 101 and the metallic shell 1 and provided between the second terminal module 102 and the metallic shell 1 for insulation can be omitted, thereby reducing the production of defect products during manufacturing the connector.

Figure 5:
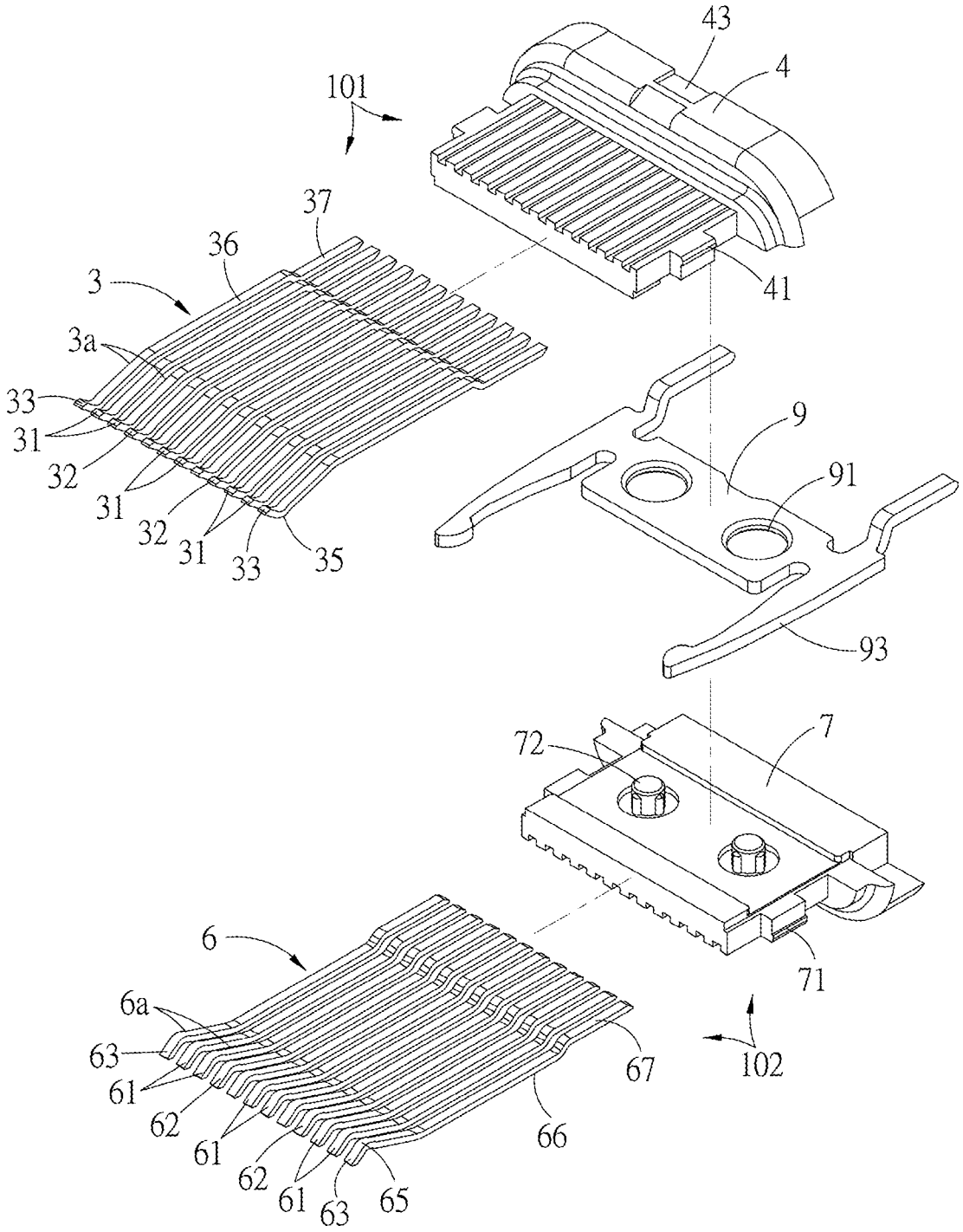
FIG. 5 illustrates an exploded view (4) of the electrical plug connector of the first embodiment.
Figure 6:
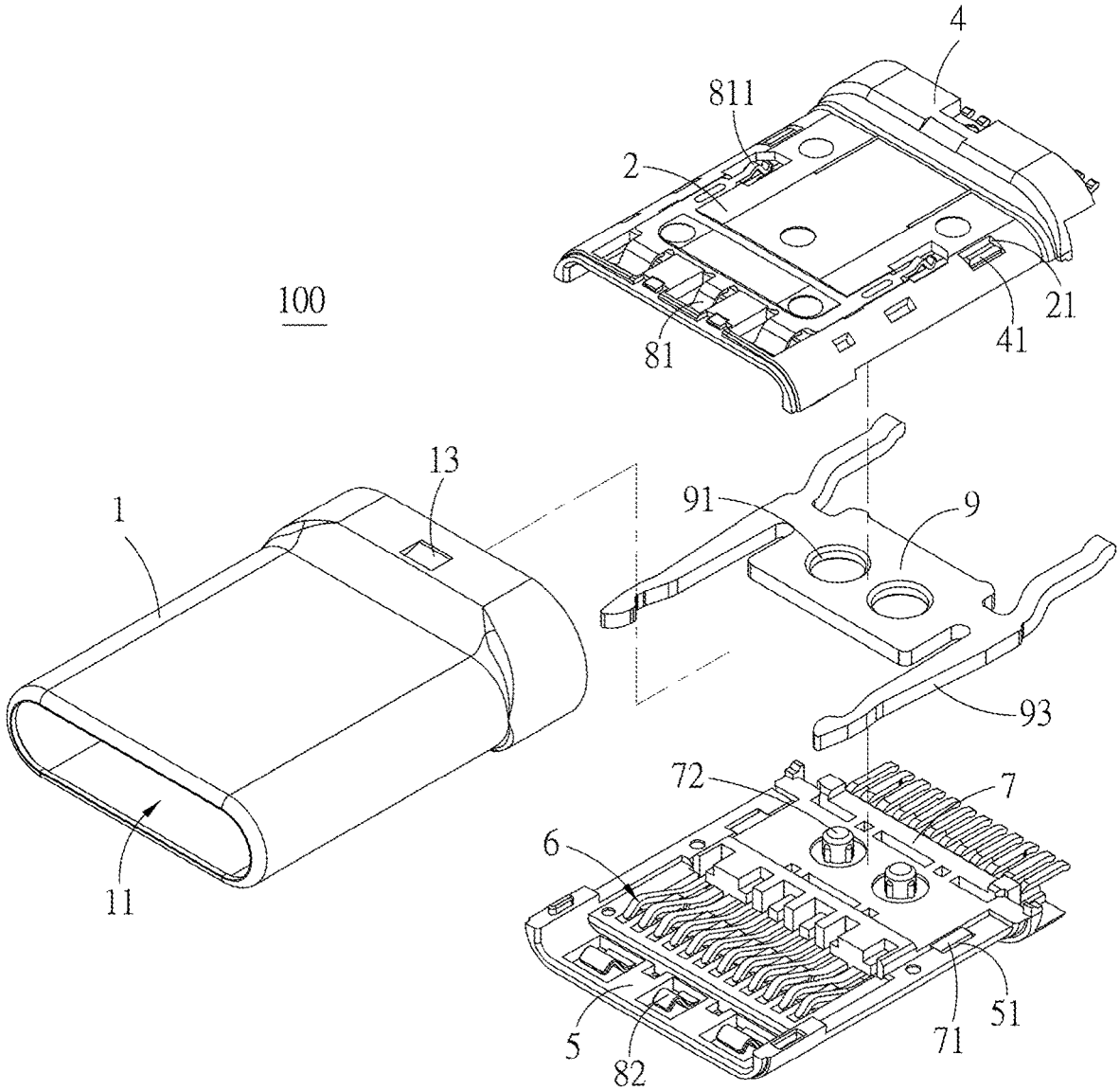
FIG. 6 illustrates an exploded view (5) of the electrical plug connector of the first embodiment.
Figure 7:
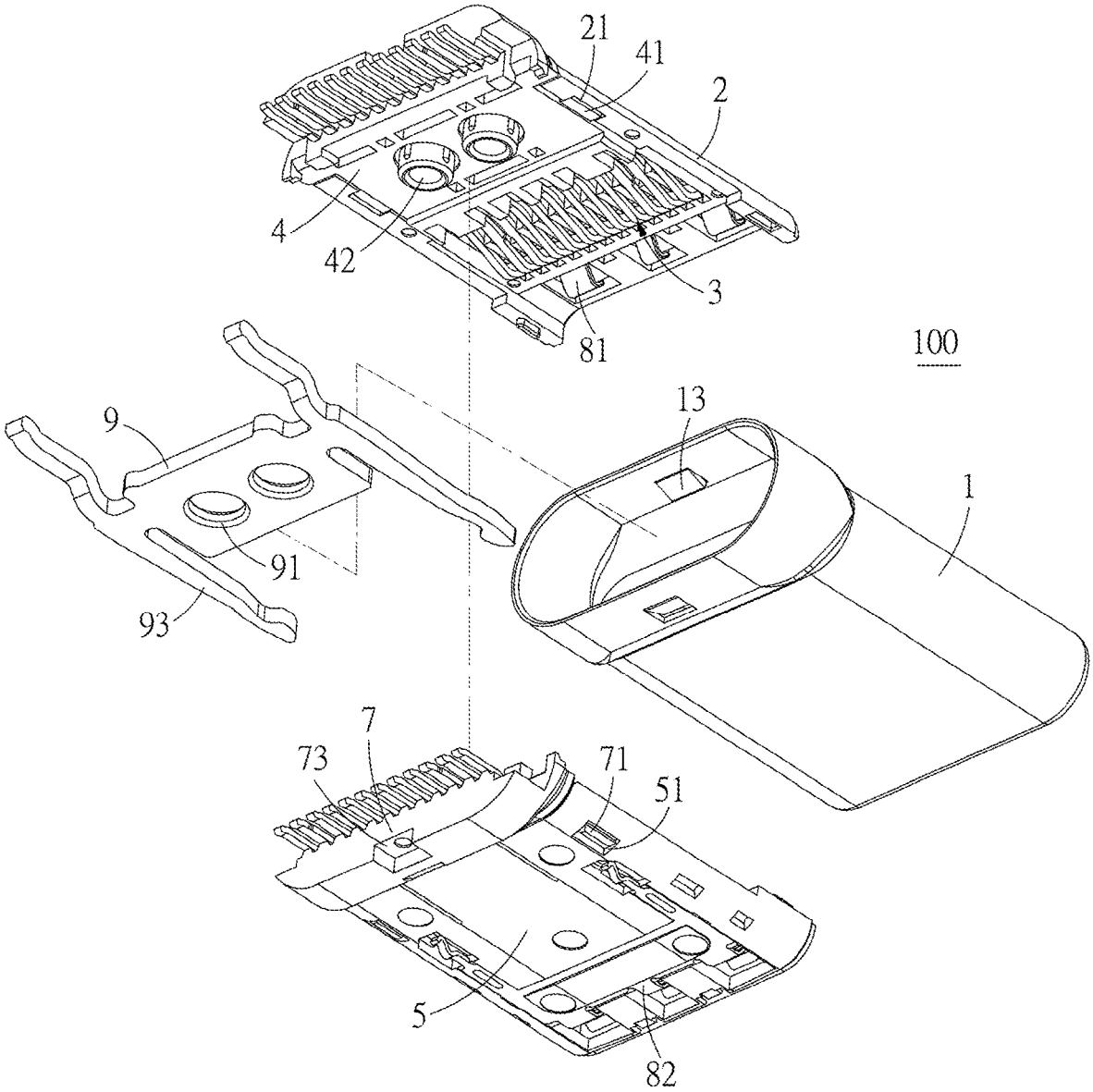
FIG. 7 illustrates an exploded view (6) of the electrical plug connector of the first embodiment.
Figure 9:
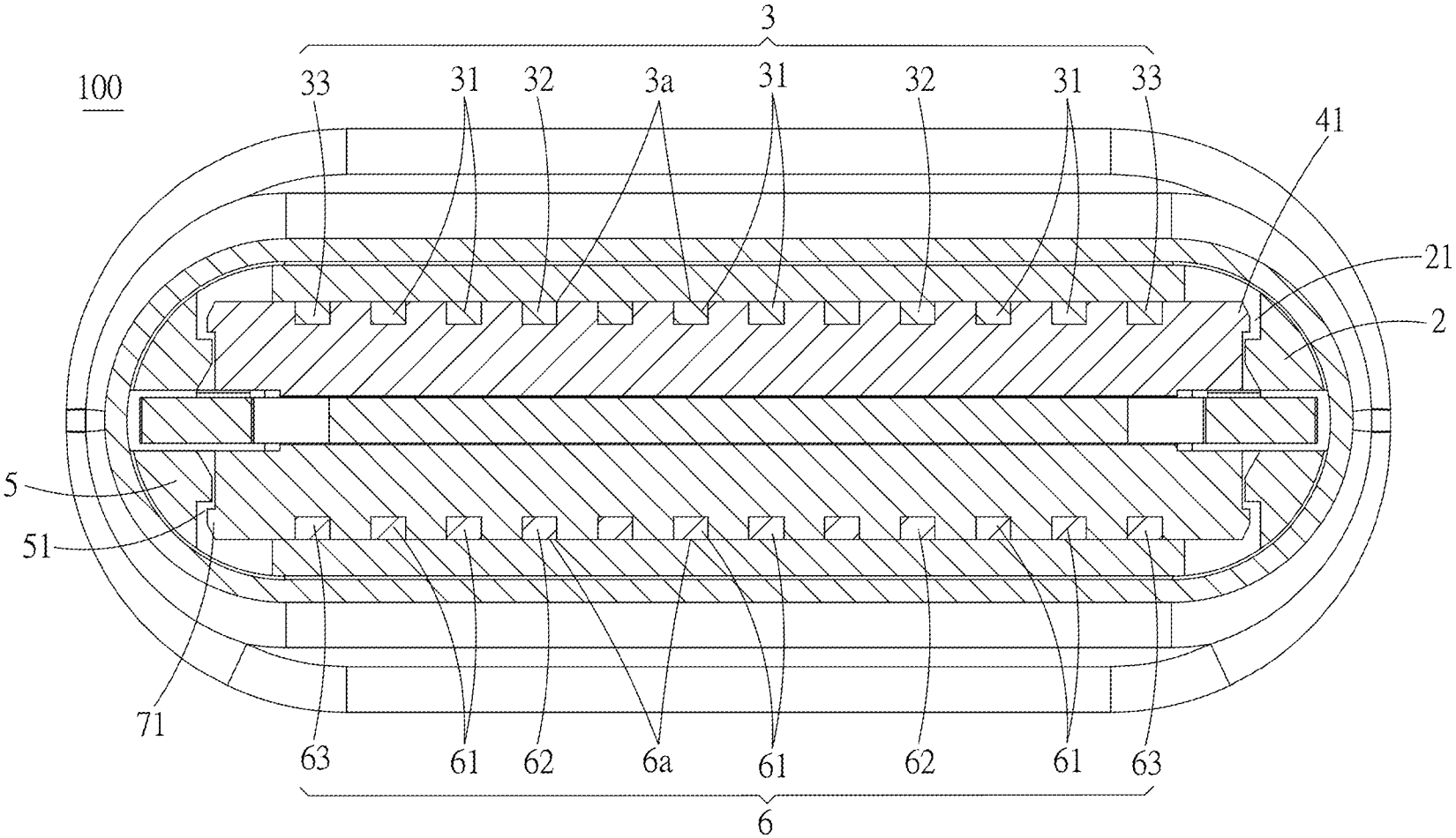
FIG. 9 illustrates a front sectional view of the electrical plug connector of the first embodiment.

Please refer to FIGS. 1 to 4. In some embodiments, more specifically, the first insulated housing 2 and the second insulated housing 5 are half portions of a tubular structure, respectively. In other words, in some embodiments, the first insulated housing 2 and the second insulated housing 5 each is a half-tubular elongated plate. The upper portion of the insulated housing (the first insulated housing 2 and the second insulated housing 5) is symmetrical to the lower portion of the insulated housing (the first insulated housing 2 and the second insulated housing 5), and the left portion of the insulated housing (the first insulated housing 2 and the second insulated housing 5) is symmetrical to the right portion of the insulated housing (the first insulated housing 2 and the second insulated housing 5). Moreover, the first insulated housing 2 is combined with the second insulated housing 5 to form the tubular structure, and the insertion cavity is formed inside the tubular structure for mating with an electrical receptacle connector. Please further refer to FIGS. 3 to 9. FIG. 5 illustrates an exploded view (4) of the electrical plug connector 100 of the first embodiment. FIG. 6 illustrates an exploded view (5) of the electrical plug connector 100 of the first embodiment. FIG. 7 illustrates an exploded view (6) of the electrical plug connector 100 of the first embodiment. FIG. 8 illustrates a side sectional view of the electrical plug connector 100 of the first embodiment. FIG. 9 illustrates a front sectional view of the electrical plug connector 100 of the first embodiment. Specifically, FIG. 5 illustrates an exploded view of some components of the electrical plug connector 100 of the first embodiment, FIG. 6 illustrates a front exploded view showing the assembled components of the electrical plug connector 100 of the first embodiment, and FIG. 7 illustrates a rear exploded view showing the assembled components of the electrical plug connector 100 of the first embodiment. In some embodiments, the first terminals 3 comprise a plurality of first signal terminals 31, at least one power terminal 32, and at least one ground terminal 33. From a front view of the first terminals 3, the first terminals 3 comprise, from right to left, a ground terminal 33 (Gnd), a first pair of first signal terminals 31 (TX1+−, high-speed differential signal terminals), a power terminal 32 (Power/VBUS), a first function detection terminal (CC1, a terminal for inserting orientation detection of the connector and for cable recognition), a pair of signal terminals 31 (D+−, low-speed differential signal terminals), a first reserved terminal (RFU), another power terminal 32 (Power/VBUS), a second pair of first signal terminals 31 (RX2+−, high-speed differential signal terminals), and another ground terminal 33 (Gnd).

Please refer to FIGS. 3 to 9. In some embodiments, each of the first terminals 3 is a bent-type terminal. Each of the first terminals 3 comprises a first flexible contact portion 35, a first body portion 36, and a first tail portion 37. In this embodiment, the first body portions 36 are held in the first assembling block 4. The first flexible contact portion 35 extends forward from the first body portion 36 in the rear-to-front direction, and the first tail portion 37 extends backward from the first body portion 36 in the front-to-rear direction and protrudes out of the first assembling block 4. The first flexible contact portion 35 has a curved profile. The first signal terminals 31 extend into the insertion cavity and are provided for transmitting first signals (i.e., USB 3.0 signals or other signals (for example, but not limited to, HDMI signals)). It is understood that, in some embodiments, the number of the first terminals 3 may be reduced for USB 2.0 signal transmission.

Please refer to FIGS. 3 to 9. In some embodiments, the second terminals 6 comprise a plurality of signal terminals 61, at least one power terminal 62, and at least one ground terminal 63. From a front view of the second terminals 6, the second terminals 6 comprise, from left to right, a ground terminal 63 (Gnd), a first pair of second signal terminals 61 (TX2+−, high-speed differential signal terminals), a power terminal 62 (Power/VBUS), a second function detection terminal (CC2, a terminal for inserting orientation detection of the connector and for cable recognition), a pair of signal terminals 61 (D+−, low-speed differential signal terminals), a second reserved terminal (RFU), another power terminal 62 (Power/VBUS), a second pair of second signal terminals 61 (RX1+−, high-speed differential signal terminals), and another ground terminal 63 (Gnd).

Please refer to FIGS. 3 to 9. In some embodiments, each of the second terminals 6 is a bent-type terminal. Each of the second terminals 6 comprises a second flexible contact portion 65, a second body portion 66, and a second tail portion 67. In this embodiment, the second body portions 66 are held in the second assembling block 7. The second flexible contact portion 65 extends forward from the second body portion 66 in the rear-to-front direction, and the second tail portion 67 extends backward from the second body portion 66 in the front-to-rear direction and protrudes out of the second assembling block 7. The second flexible contact portion 65 has a curved profile, and the second flexible contact portions 65 correspond to the first flexible contact portions 35. In other words, for example, the first flexible contact portion 35 may be curved inward but the corresponding second flexible contact portion 65 may be curved outward. Each of the first tail portions 37 and the corresponding second tail portion 67 form a clamp for holding and contacting a circuit board. Moreover, the second terminals 6 are provided for transmitting second signals (i.e., USB 3.0 signals or other signals (for example, but not limited to, HDMI signals)). It is understood that, in some embodiments, the number of the second terminals 6 may be reduced for USB 2.0 signal transmission.

Please refer to FIGS. 1 to 4. In some embodiments, more specifically, the first assembling block 4 is formed with the first terminals 3, and the second assembling block 7 is formed with the second terminals 6. In this embodiment, the first assembling block 4 is combined with the first body portions 36 by insert-molding, and then the second assembling block 7 is combined with the second body portions 66 by insert-molding. Next, the first assembling block 4 combined with the first terminals 3 and the second assembling block 7 combined with the second terminals 6 are respectively assembled on the upper portion and the lower portion of a metallic member 9. Thereafter, a semi-product formed by the metallic member 9, the first terminal module 101, and the second terminal module 102 are assembled into the receiving cavity 11 of the metallic shell 1.

Please refer to FIGS. 3 to 9. In some embodiments, two sides of the first insulated housing 2 comprise two first buckling grooves 21, two sides of the first assembling block 4 comprise two first engaging blocks 41, and each of the first engaging blocks 41 is engaged with the corresponding first buckling groove 21. Similarly, in some embodiments, two sides of the second insulated housing 5 comprise two second buckling grooves 51, two sides of the second assembling block 7 comprise two second engaging blocks 71, and each of the second engaging blocks 71 is engaged with the corresponding second buckling groove 51.

Please refer to FIGS. 3 to 9. In some embodiments, an inner side of the first assembling block 4 comprises a first positioning structure 42 (the first positioning structure 42 may be a convex structure (i.e. a post structure) or a concave structure (i.e. a hole structure)), an inner side of the second assembling block 7 comprises a second positioning structure 72 (the second positioning structure 72 may be a convex structure (i.e. a post structure) or a concave structure (i.e. a hole structure)), and the first positioning structure 42 is combined with the second positioning structure 72 (a combination of a convex structure and a concave structure). In this embodiment, the first positioning structure 42 has a recessed hole, and the second positioning structure 72 has a protrusion so as to be engaged into the recessed hole.

Please refer to FIGS. 3 to 9. In some embodiments, the electrical plug connector 100 further comprises a metallic member 9, and the metallic member 9 is between the first insulated housing 2 and the second insulated housing 5.

Please refer to FIGS. 3 to 9. In some embodiments, more specifically, the metallic member 9 is formed by blanking techniques, but embodiments are not limited thereto. In some embodiments, the metallic member 9 may be formed by stamping techniques. A metallic member 9 may be formed by blanking techniques. Moreover, the metallic member 9 further includes two side latches, and two elastic side arms 93 of two side latches respectively extend from two sides of the metallic member 9 along the rear-to-front direction. The middle portion of the metallic member 9 is approximately formed as a rectangular plate and has at least one buckling hole 91. The first positioning structure 42 and the second positioning structure 72 are inserted into the corresponding buckling hole 91, so that the metallic member 9 is positioned between the first insulated housing 2 and the second insulated housing 5.

Please refer to FIGS. 3 to 9. In some embodiments, each of the side arms 93 is an elongate latch structure. Moreover, the side arms 93 are symmetrical with each other. The side arms 93 extend outward from two sides of the metallic member 9 in a same direction, respectively, and the side arms 93 are disposed in the two sides of the first insulated housing 2 and the second insulated housing 5 along a transverse direction. The transverse direction is perpendicular to the vertical direction and longitudinal direction. Each of the side latches further comprises a latch portion and a leg. Each of the latch portions is at the front portion of the corresponding side arm 93 and is inserted into the insertion cavity along the transverse direction. The latch portions of the side latches are provided for latching and contacting a tongue portion of an electrical receptacle connector. Additionally, the latch portions of the side latches are provided for latching and contacting a mid-plate inside a tongue portion of a USB type-C electrical receptacle connector. The metallic member 9 and two side latches can be a unitary element or the metallic member 9 and two side latches can be discrete elements.

When the electrical plug connector 100 is mated with an electrical receptacle connector, the latch portions of the side arms 93 provide a holding function for positioning with the electrical receptacle connector. Moreover, each of the legs extends from the rear portion of the corresponding side arm 93, and the legs protrude out of the first insulated housing 2 and the second insulated housing 5 so as to contact the circuit board.

Please refer to FIGS. 3 to 9. In some embodiments, the electrical plug connector 100 further comprises a first metallic sheet 81 which is on an outer appearance surface of the first insulated housing 2 and near a front end of the first insulated housing 2. Moreover, in some embodiments, the electrical plug connector 100 further comprises a second metallic sheet 82 which is on an outer appearance surface of the second insulated housing 5 and near a front end of the second insulated housing 5. The first metallic sheet 81 comprises a plurality of first elastic arms extending into the insertion cavity, and the second metallic sheet 82 comprises a plurality of second elastic arms extending into the insertion cavity. During the assembling, first, the first metallic sheet 81 is assembled on the first insulated housing 2 along the vertical direction, and then the first insulated housing 2 is assembled with the first assembling block 4 to form an upper component. Next, the second metallic sheet 82 is assembled on the second insulated housing 5 along the vertical direction, and then the second insulated housing 5 is assembled with the second assembling block 7 to form a lower component. Thereafter, the upper component and the lower component are assembled into the metallic shell 1.

Please refer to FIGS. 3 to 7. In some embodiments, the first terminals 3 comprise a plurality of first bent-type terminals 3*a* for grounding, power transmission, and signal transmission, respectively, and the second terminals 6 comprise a plurality of second bent-type terminals 6*a* for grounding, power transmission, and signal transmission, respectively. Moreover, the first bent-type terminals 3*a* and the second bent-type terminals 6*a* are flexible terminals, but embodiments are not limited thereto.

Figure 10:
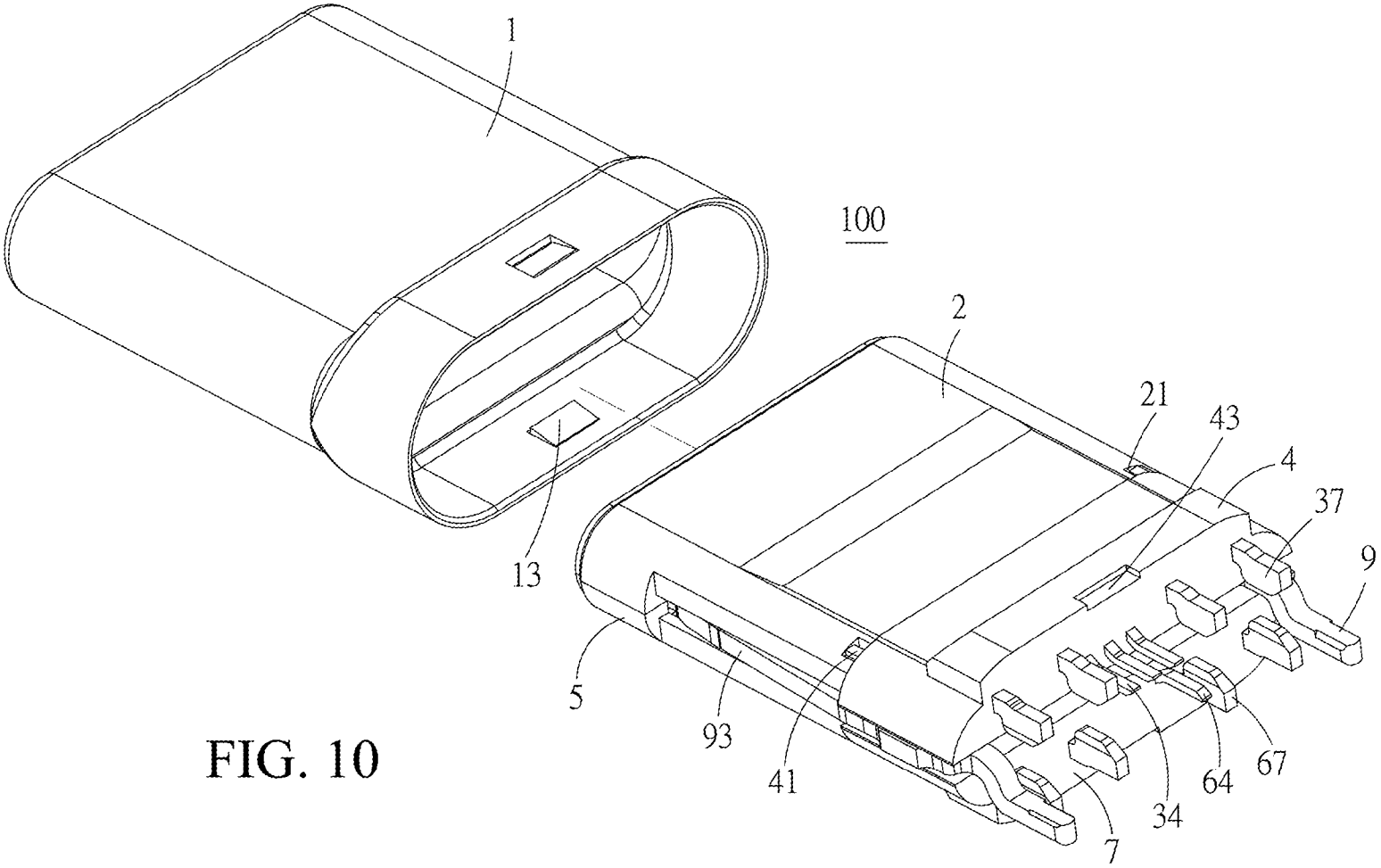
FIG. 10 illustrates an exploded view (1) of an electrical plug connector according to a second embodiment of the instant disclosure.
Figure 11:
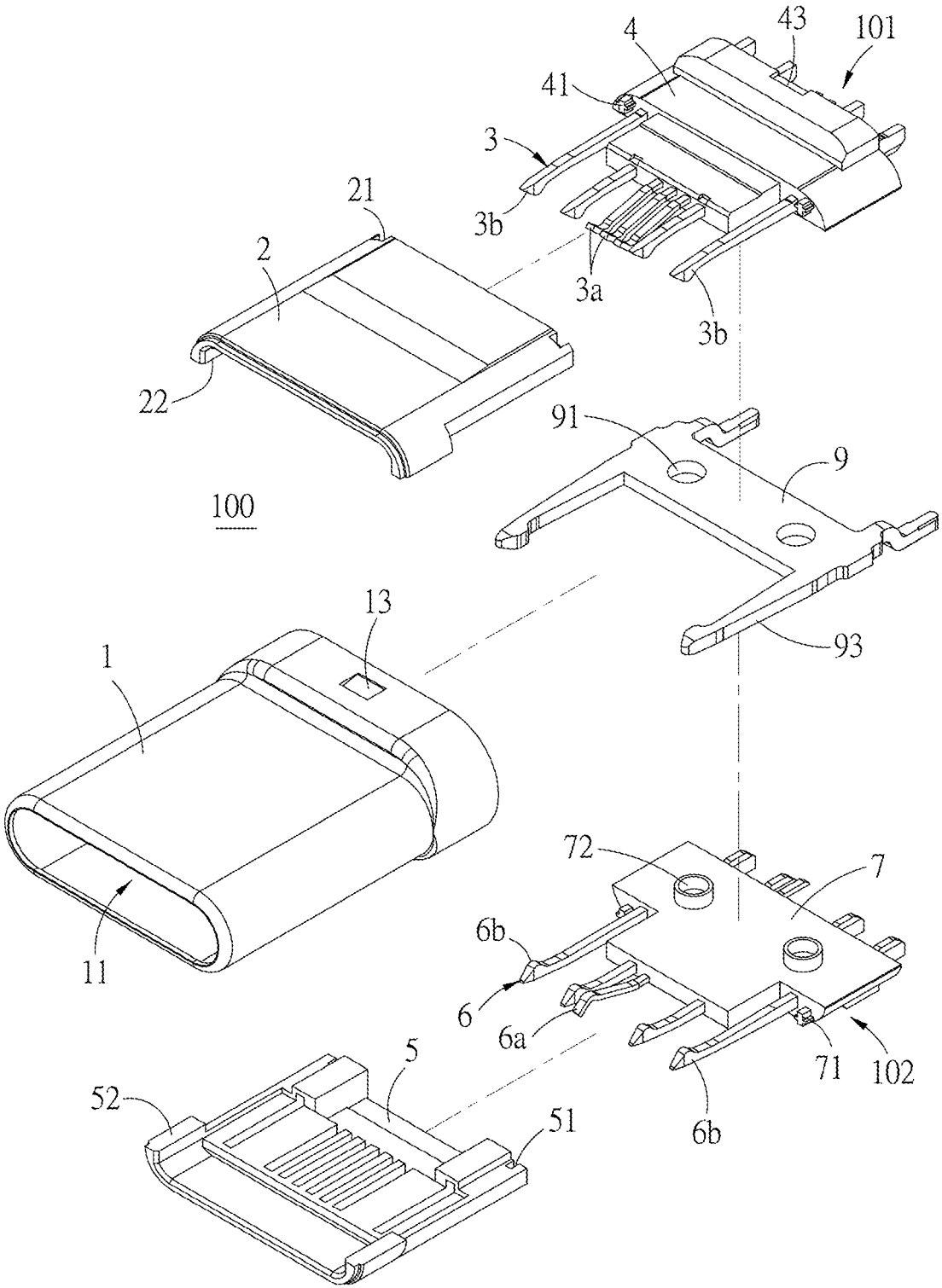
FIG. 11 illustrates an exploded view (2) of the electrical plug connector of the second embodiment.
Figure 12:
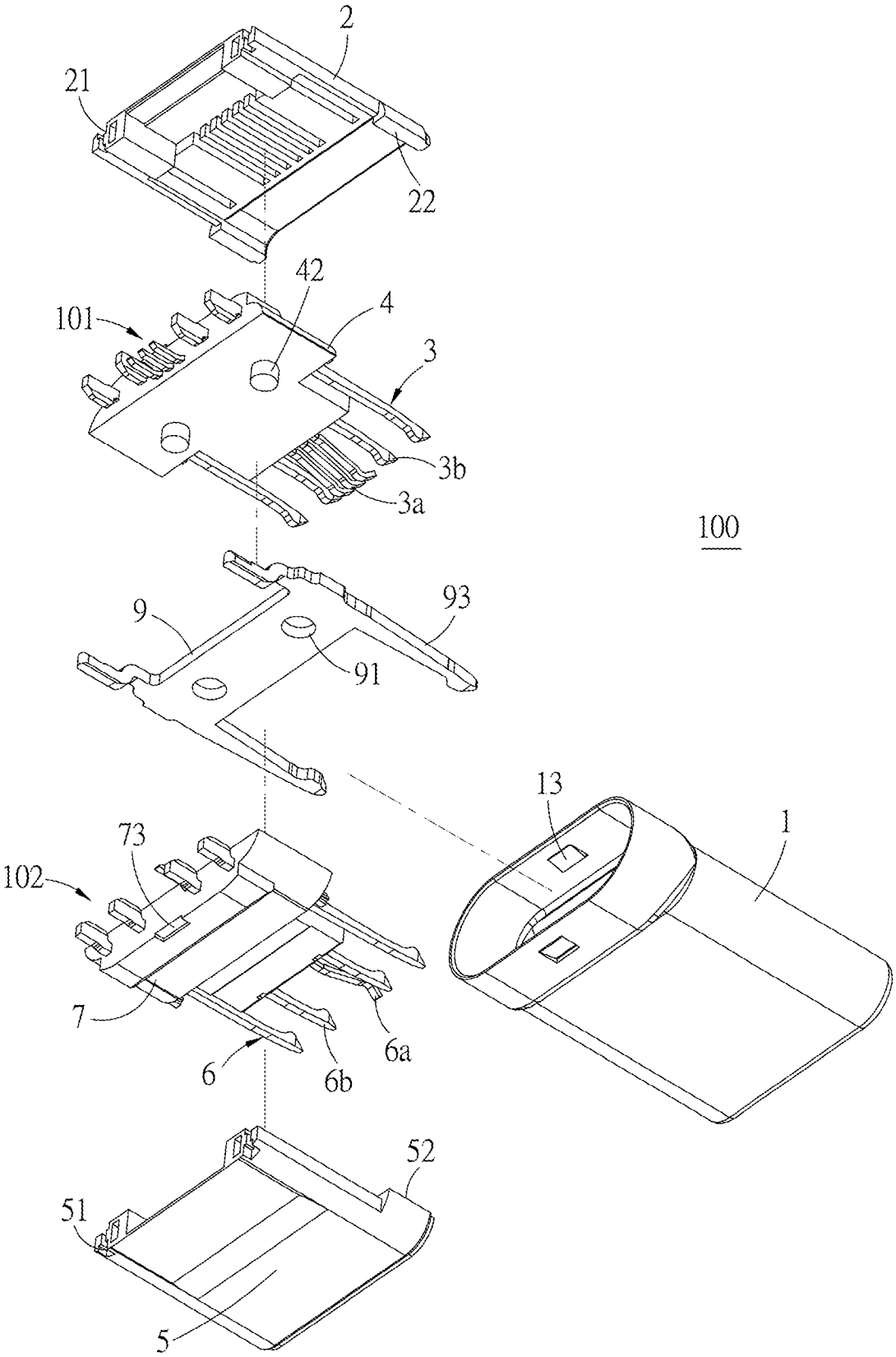
FIG. 12 illustrates an exploded view (3) of the electrical plug connector of the second embodiment.

Please refer to FIGS. 10 to 12. An electrical plug connector 100 according to a second embodiment of the instant disclosure is illustrated, and FIGS. 10 to 12 respectively illustrate schematic views showing the assembling procedures for the connector. In this embodiment, the first terminals 3 comprise a plurality of first blanking-type terminals 3*b* for grounding and power transmission, respectively, and the first terminals 3 comprise a plurality of first bent-type terminals 3*a* for signal transmission. The first bent-type terminals 3*a* and the first blanking-type terminals 3*b* are combined with the first assembling block 4. The first bent-type terminals 3*a* are between the first blanking-type terminals 3*b* for power transmission, and the first blanking-type terminals 3*b* for grounding are at two outer sides of the first blanking-type terminals 3*b* for power transmission. Likewise, the second terminals 6 comprise a plurality of second blanking-type terminals 6*b* for grounding and power transmission, respectively, and the second terminals 6 comprise at least one second bent-type terminal 6*a* for signal transmission. The at least one second bent-type terminal 6*a* and the second blanking-type terminals 6*b* are combined with the second assembling block 7. The at least one second bent-type terminal 6*a* is between the second blanking-type terminals 6*b* for power transmission, and the second blanking-type terminals 6*b* for grounding are at two outer sides of the second blanking-type terminals 6*b* for power transmission.

Figure 16:
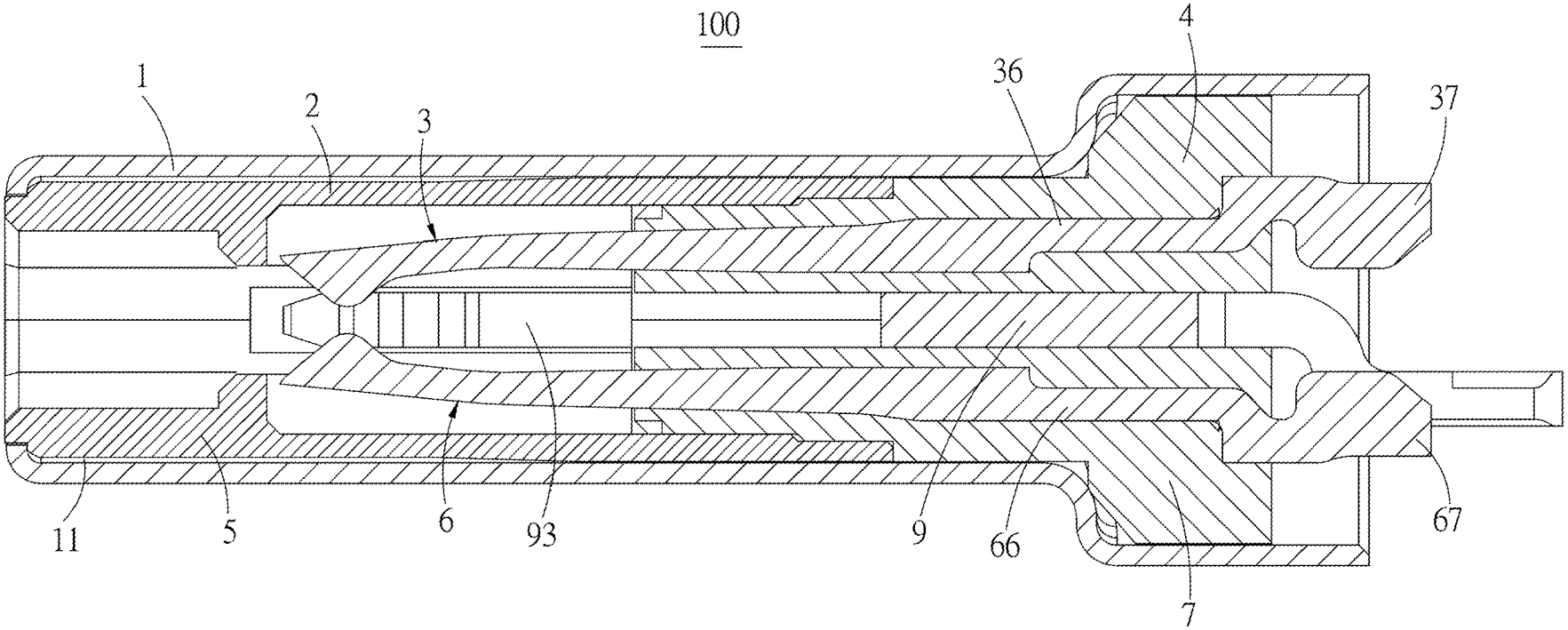
FIG. 16 illustrates a side sectional view of the electrical plug connector of the second embodiment.
Figure 17:
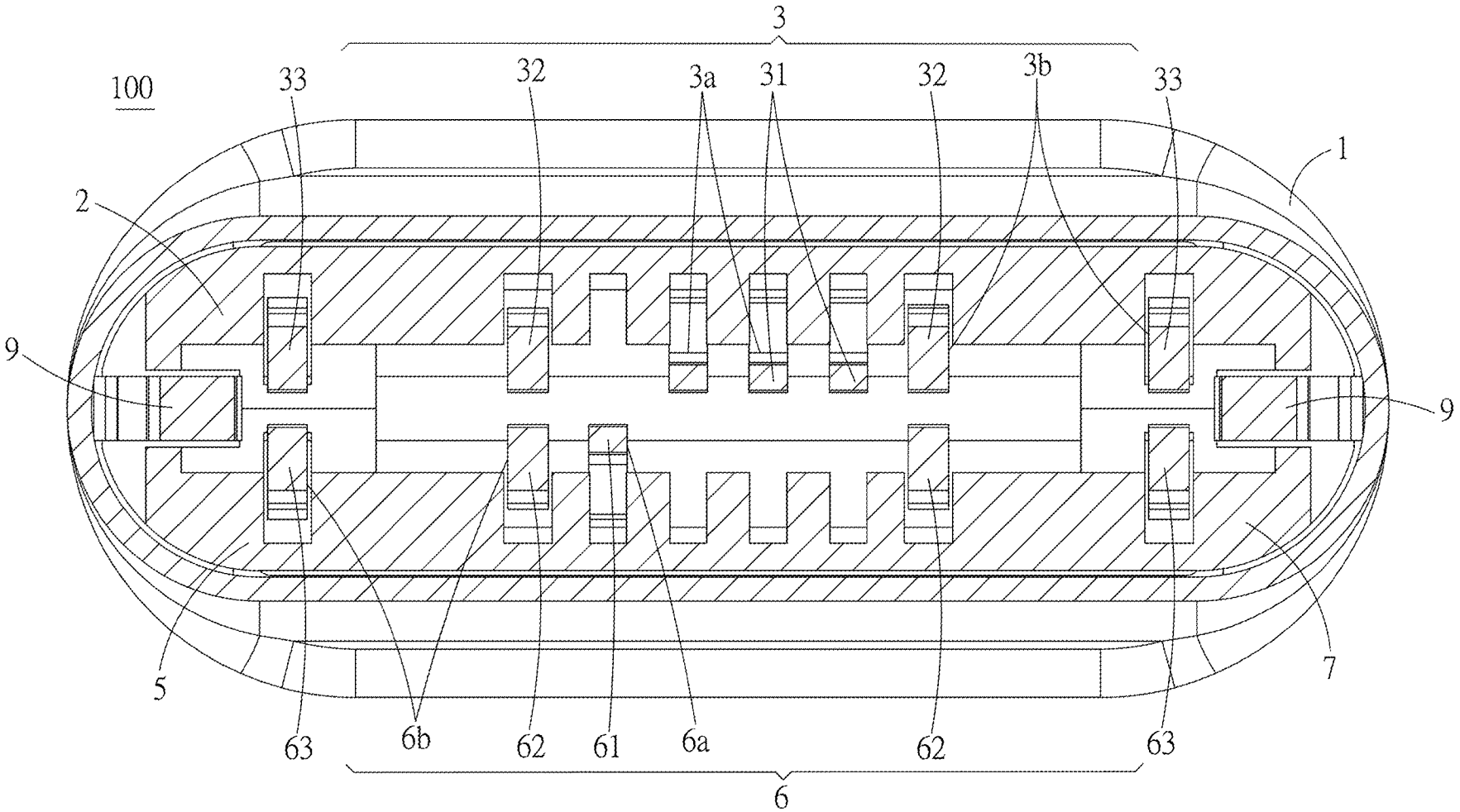
FIG. 17 illustrates a front sectional view of the electrical plug connector of the second embodiment.

Please refer to FIGS. 11, 16, and 17. FIG. 16 illustrates a side sectional view of the electrical plug connector of the second embodiment, and FIG. 17 illustrates a front sectional view of the electrical plug connector of the second embodiment. In some embodiments, the thickness of the first bent-type terminal 3*a* is less than the thickness of the first blanking-type terminal 3*b*, and the thickness of the second bent-type terminal 6*a* is less than the thickness of the second blanking-type terminal 6*b*.

Figure 13:
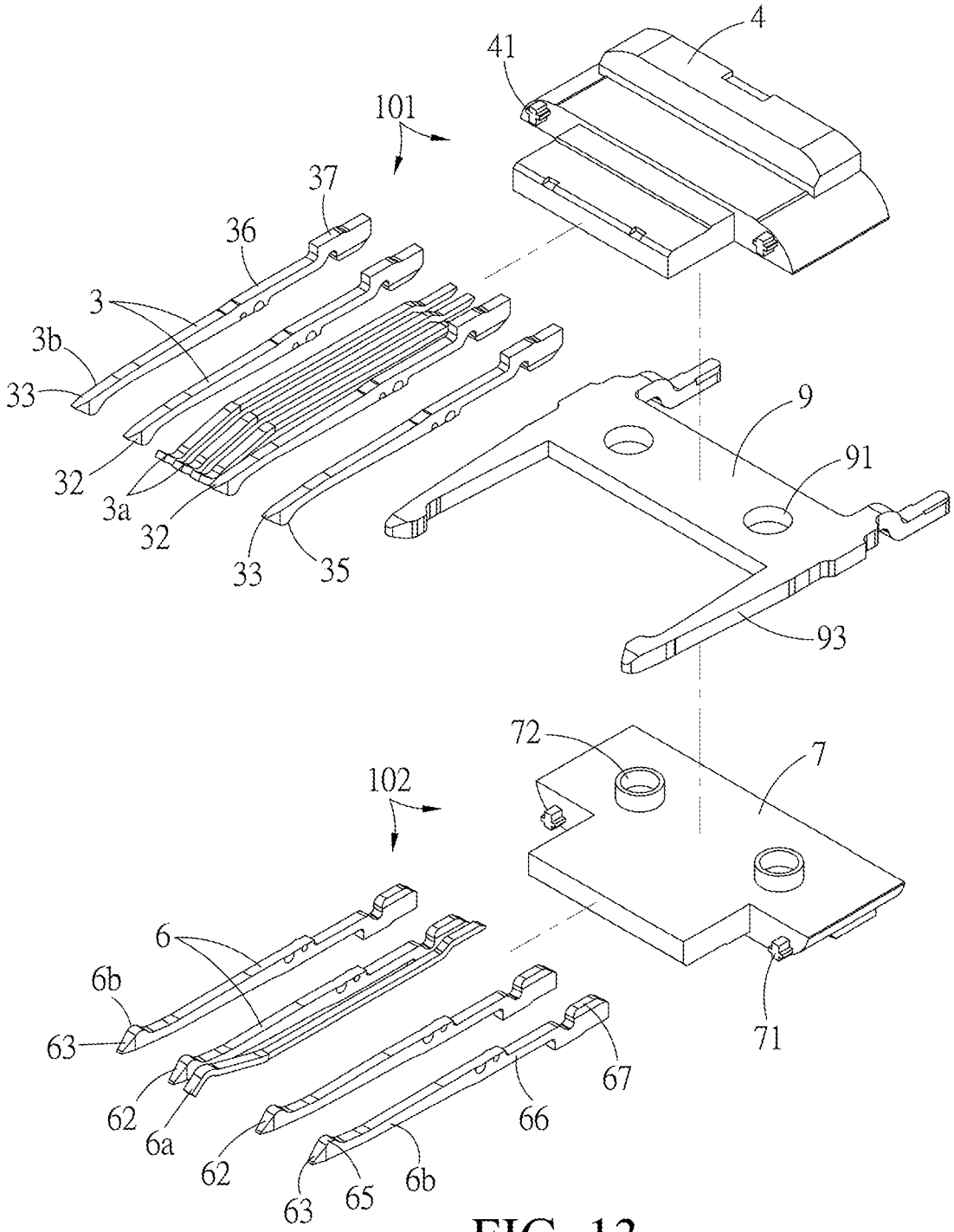
FIG. 13 illustrates an exploded view (4) of the electrical plug connector of the second embodiment.
Figure 14:
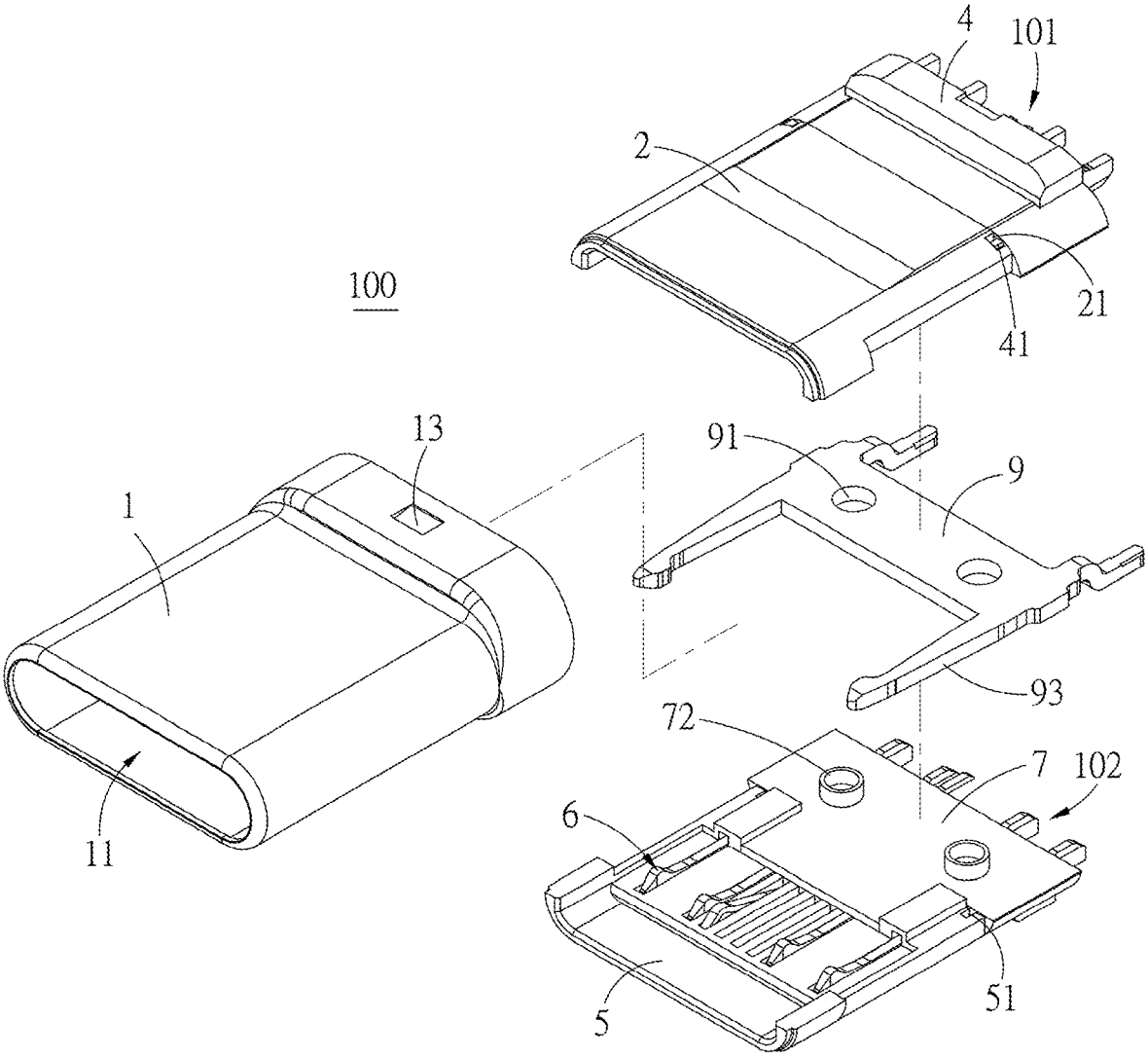
FIG. 14 illustrates an exploded view (5) of the electrical plug connector of the second embodiment.
Figure 15:
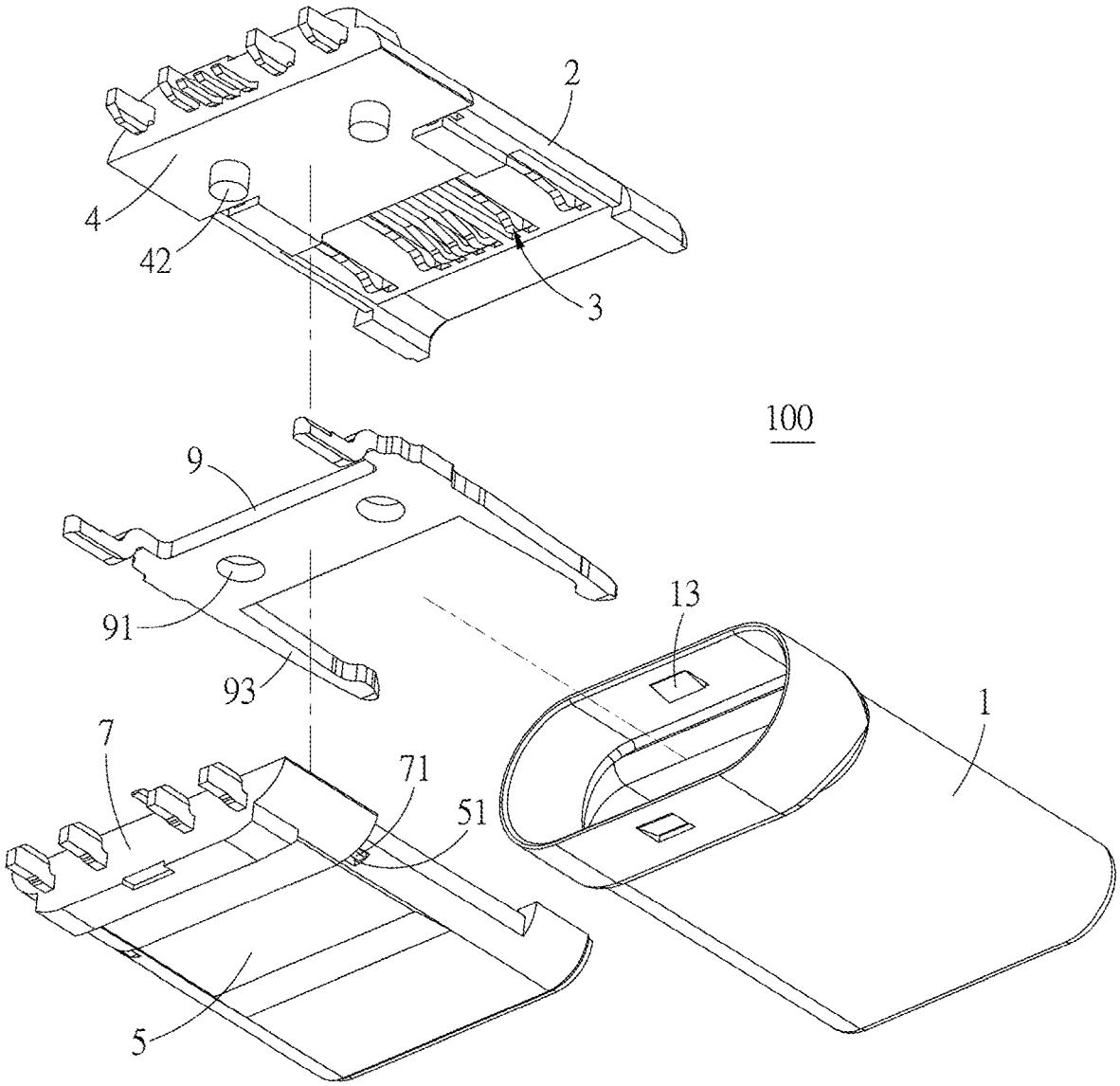
FIG. 15 illustrates an exploded view (6) of the electrical plug connector of the second embodiment.

Please refer to FIGS. 13 to 15. FIGS. 13 to 15 respectively illustrate schematic views showing the assembling procedures for the connector. In some embodiments, the first bent-type terminals 3*a* are arranged between the first blanking-type terminals 3*b*, and the at least one second bent-type terminal 6*a* is arranged between the second blanking-type terminals 6*b*.

Please refer to FIGS. 11 and 12. In some embodiments, the first terminals 3 comprise a plurality of first signal terminals 31, at least one power terminal 32, and at least one ground terminal 33. From a front view of the first terminals 3, the first terminals 3 comprise, from right to left, a ground terminal 33 (Gnd), a power terminal 32 (Power/VBUS), a first function detection terminal (CC1, a terminal for inserting orientation detection of the connector and for cable recognition), a pair of first bent-type terminals 3*a* (signal terminals 31, D+−, low-speed differential signal terminals), a first reserved terminal (RFU), another power terminal 32 (Power/VBUS), and another ground terminal 33 (Gnd).

Please refer to FIGS. 11 and 12. In some embodiments, the second terminals 6 comprise a plurality of signal terminals 61, at least one power terminal 62, and at least one ground terminal 63. From a front view of the second terminals 6, the second terminals 6 comprise, from left to right, a ground terminal 63 (Gnd), a power terminal 62 (Power/VBUS), a second function detection terminal (CC2, a terminal for inserting orientation detection of the connector and for cable recognition), at least one second bent-type terminal 6*a* (signal terminal 61), a second reserved terminal (RFU), another power terminal 62 (Power/VBUS), and another ground terminal 63 (Gnd).

According to one or some embodiments of the instant disclosure, the first terminal module comprises the first terminals and the first assembling block combined with each other to form a one-piece member by injection molding, and then the first insulated housing is further combined with the first terminal module; likewise, the second terminal module comprises the second terminals and the second assembling block combined with each other to form a one-piece member by injection molding, and then the second insulated housing is further combined with the second terminal module. The four-piece component is assembled into the metallic shell. Accordingly, the number of the components for manufacturing the connector can be reduced, thereby simplifying the assembling procedure for the connector. Moreover, after the first assembling block and the second assembling block are respectively combined with the first terminals and the second terminals, the first terminal module and the second terminal module provide waterproof function.

According to one or some embodiments of the instant disclosure, the first bent-type terminals and the second bent-type terminals meet the Gen2 specification, and the first bent-type terminals and the second bent-type terminals are served as terminals for signal transmission. Conversely, the first blanking-type terminals and the second blanking-type terminals are served as terminals for power transmission. The cross-sectional area of the blanking-type terminal is greater than the cross-sectional area of the bent-type terminal thereby suitable for transmitting a current having 6 Amps or more.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell comprising a receiving cavity;

a first insulated housing comprising a first inner assembling space;

a first terminal module comprising a plurality of first terminals and a first assembling block, wherein the first assembling block is assembled in the first inner assembling space of the first insulated housing;

a second insulated housing comprising a second inner assembling space; and a second terminal module comprising a plurality of second terminals and a second assembling block, wherein the second assembling block is assembled in the second inner assembling space of the second insulated housing;

wherein the first insulated housing assembled with the first terminal module and the second insulated housing assembled with the second terminal module are combined with each other and together received in the receiving cavity of the metallic shell, an insertion cavity is between an inner side of an assembly of the first insulated housing and the second insulated housing after the first insulated housing is combined with the second insulated housing.

2. The electrical plug connector according to claim 1, wherein the first assembling block is received and retained in the first inner assembling space of the first insulated housing and the second assembling block is received and retained in the second inner assembling space of the second insulated housing.

3. The electrical plug connector according to claim 1, wherein each of the first terminals comprises a first flexible contact portion, a first body portion, and a first tail portion, the first body portions are held in the first assembling block; wherein for each of the first terminals, the first flexible contact portion extends forward from the first body portion in a rear-to-front direction, and the first tail portion extends backward from the first body portion in a front-to-rear direction and protrudes out of the first assembling block.

4. The electrical plug connector according to claim 1, wherein each of the second terminals comprises a second flexible contact portion, a second body portion, and a second tail portion, the second body portions are held in the second assembling block; wherein for each of the second terminals, the second flexible contact portion extends forward from the second body portion in a rear-to-front direction, and the second tail portion extends backward from the second body portion in a front-to-rear direction and protrudes out of the second assembling block.

5. The electrical plug connector according to claim 1, wherein two sides of the first insulated housing comprise two first buckling grooves, two sides of the first assembling block comprise two first engaging blocks, and each of the first engaging blocks is engaged with the corresponding first buckling groove.

6. The electrical plug connector according to claim 1, wherein two sides of the second insulated housing comprise two second buckling grooves, two sides of the second assembling block comprise two second engaging blocks, and each of the second engaging blocks is engaged with the corresponding second buckling groove.

7. The electrical plug connector according to claim 1, wherein an inner side of the first assembling block comprises a first positioning structure, an inner side of the second assembling block comprises a second positioning structure, and the first positioning structure is combined with the second positioning structure.

8. The electrical plug connector according to claim 7, further comprising a metallic member between the first insulated housing and the second insulated housing, wherein the metallic member comprises a buckling hole and two side latches, the buckling hole is provided for being inserted by the first positioning structure, and the two side latches respectively extend from two sides of the metallic member along a rear-to-front direction.

9. The electrical plug connector according to claim 8, wherein each of side latches comprises a side arm and a latch portion, wherein the latch portion is at a front portion of the side arm and inserted into the insertion cavity along a transverse direction.

10. The electrical plug connector according to claim 1, further comprising two side latches disposed on two sides of the first insulated housing and the second insulated housing along a transverse direction, and each of side latches comprises a side arm and a latch portion, wherein the latch portion is at a front portion of the side arm and inserted into the insertion cavity along a transverse direction.

11. The electrical plug connector according to claim 1, further comprising a first metallic sheet and a second metallic sheet, wherein the first metallic sheet is on the first insulated housing, and the second metallic sheet is on the second insulated housing.

12. An electrical plug connector, comprising:

a metallic shell comprising a receiving cavity along a longitudinal direction;

a first insulated housing comprising a first inner assembling space;

a first terminal module comprising a plurality of first terminals and a first assembling block, wherein the first assembling block is assembled and retained in the first inner assembling space of the first insulated housing along a vertical direction;

a second insulated housing comprising a second inner assembling space; and a second terminal module comprising a plurality of second terminals and a second assembling block, wherein the second assembling block is assembled and retained in the second inner assembling space of the second insulated housing along the vertical direction;

wherein the first insulated housing assembled with the first terminal module and the second insulated housing assembled with the second terminal module are combined with each other along the vertical direction and together received in the receiving cavity of the metallic shell, an insertion cavity is between an inner side of an assembly of the first insulated housing and the second insulated housing after the first insulated housing is combined with the second insulated housing along the vertical direction.

13. The electrical plug connector according to claim 12, wherein an inner side of the first assembling block comprises a first positioning structure, an inner side of the second assembling block comprises a second positioning structure, and the first positioning structure is combined with the second positioning structure.

14. The electrical plug connector according to claim 13, further comprising a metallic member between the first insulated housing and the second insulated housing, wherein the metallic member comprises a buckling hole and two side latches, the buckling hole is provided for being inserted by the first positioning structure, and the two side latches extend from two sides of the metallic member.

15. The electrical plug connector according to claim 14, wherein each of side latches comprises a side arm and latch portion, wherein the latch portion is at a front portion of the side arm and inserted into the insertion cavity along a transverse direction.

16. The electrical plug connector according to claim 12, further comprising two side latches disposed on two sides of the first insulated housing and the second insulated housing along a transverse direction, and each of side latches comprises a side arm and a latch portion, wherein the latch portion is at a front portion of the side arm and inserted into the insertion cavity along the transverse direction.

17. An electrical plug connector, comprising:

a metallic shell comprising a receiving cavity;

a first insulated housing comprising a first inner assembling space;

a first terminal module comprising a plurality of first terminals and a first assembling block, wherein the first assembling block is received and assembled in the first inner assembling space of the first insulated housing;

a second insulated housing comprising a second inner assembling space;

a second terminal module comprising a plurality of second terminals and a second assembling block, wherein the second assembling block is received and assembled in the second inner assembling space of the second insulated housing; and two side latches disposed on two sides of the first insulated housing and the second insulated housing along a transverse direction, and each of side latches comprises a side arm and a latch portion, wherein the latch portion is at a front portion of the side arm and inserted into the insertion cavity along the transverse direction;

wherein the first insulated housing assembled with the first terminal module and the second insulated housing assembled with the second terminal module are combined with each other along a vertical direction and together received in the receiving cavity of the metallic shell, an insertion cavity is between an inner side of an assembly of the first insulated housing and the second insulated housing after the first insulated housing is combined with the second insulated housing.

18. The electrical plug connector according to claim 17, wherein an inner side of the first assembling block comprises a first positioning structure, an inner side of the second assembling block comprises a second positioning structure, and the first positioning structure is combined with the second positioning structure.

19. The electrical plug connector according to claim 18, further comprising a metallic member between the first insulated housing and the second insulated housing, wherein the metallic member comprises a buckling hole and two side latches, the buckling hole is provided for being inserted by the first positioning structure, and the two side latches respectively extend from two sides of the metallic member along a rear-to-front direction.

20. The electrical plug connector according to claim 19, wherein each of side latches comprises a side arm and latch portion, wherein the latch portion is at a front portion of the side arm and inserted into the insertion cavity along a transverse direction.

* * * * *